US011234457B2

(12) United States Patent
Mironov et al.

(10) Patent No.: US 11,234,457 B2
(45) Date of Patent: Feb. 1, 2022

(54) AEROSOL DELIVERY SYSTEM AND METHOD OF OPERATING THE AEROSOL DELIVERY SYSTEM

(71) Applicant: PHILIP MORRIS PRODUCTS S.A., Neuchatel (CH)

(72) Inventors: Oleg Mironov, Cudrefin (CH); Ihar Nikolaevich Zinovik, Peseux (CH); Oleg Fursa, Gempenach (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 355 days.

(21) Appl. No.: 15/769,445

(22) PCT Filed: Oct. 21, 2016

(86) PCT No.: PCT/EP2016/075316
§ 371 (c)(1),
(2) Date: Apr. 19, 2018

(87) PCT Pub. No.: WO2017/068100
PCT Pub. Date: Apr. 27, 2017

(65) Prior Publication Data
US 2018/0310622 A1 Nov. 1, 2018

(30) Foreign Application Priority Data
Oct. 22, 2015 (EP) ..... 15190941

(51) Int. Cl.
*A24F 40/465* (2020.01)
*A24D 1/00* (2020.01)
(Continued)

(52) U.S. Cl.
CPC ..... *A24D 1/002* (2013.01); *A24D 1/20* (2020.01); *A24F 40/465* (2020.01); *A24F 40/50* (2020.01); *H05B 3/42* (2013.01); *A24F 40/20* (2020.01)

(58) Field of Classification Search
CPC ..... A24F 47/00–008; A24F 40/465; A24F 40/20; A24F 40/50; A24D 1/14; A24D 1/002; A24D 1/20
See application file for complete search history.

(56) References Cited

U.S. PATENT DOCUMENTS 5,613,505 A * 3/1997 Campbell ..... A24F 47/008 131/194
2015/0157756 A1 6/2015 Duffield et al.

FOREIGN PATENT DOCUMENTS

CN 1126426 A 7/1996
CN 1564744 A 1/2005
(Continued)

OTHER PUBLICATIONS

CN203969194 (Machine Translation) [online], [retrieved on May 5, 2020], retrieved from Espacenet (https://worldwide.espacenet.com/patent/) (Year: 2014).*
(Continued)

*Primary Examiner* — Michael J Felton
*Assistant Examiner* — Yana B Krinker
(74) *Attorney, Agent, or Firm* — Oblon, McClelland, Maier & Neustadt, L.L.P.

(57) ABSTRACT

An aerosol delivery system includes an inductive heating device and an aerosol-forming article. The aerosol-forming article includes a plurality of aerosol-forming segments and at least two different susceptors. The inductive heating device includes a device housing including a cavity to accommodate at least a portion of the aerosol-forming article including the plurality of aerosol-forming segments,
(Continued)

a coil arranged to surround the cavity, an electrical power source, and a power supply electronics connected to the electrical power source and to the coil. The power supply electronics supplies an alternating current to the coil to generate an alternating magnetic field having magnetic field strength and a frequency to, in at least one aerosol-forming segment, generate a thermal power which is greater than the rate of heat loss of this aerosol-forming segment.

17 Claims, 4 Drawing Sheets

(51) Int. Cl.

| | |
|---|---|
| ***A24D 1/20*** | (2020.01) |
| ***A24F 40/50*** | (2020.01) |
| ***H05B 3/42*** | (2006.01) |
| *A24F 40/20* | (2020.01) |

(56) References Cited

FOREIGN PATENT DOCUMENTS

| | | | |
|---|---|---|---|
| CN | 103079299 | A | 5/2013 |
| CN | 103988576 | A | 8/2014 |
| CN | 203969194 | | 12/2014 |
| CN | 204292204 | U | 4/2015 |
| CN | 204426707 | U | 7/2015 |
| GB | 2504731 | | 2/2014 |
| GB | 2504732 | | 2/2014 |
| JP | 3036837 | B2 | 4/2000 |
| JP | 2004-55547 | A | 2/2004 |
| JP | 3588469 | B2 | 11/2004 |
| JP | 5196672 | B2 | 5/2013 |
| JP | 5663016 | B2 | 2/2015 |
| WO | WO 95/27411 | | 10/1995 |
| WO | WO 2014/048745 | | 4/2014 |

OTHER PUBLICATIONS

PCT Search Report and Written Opinion for PCT/EP2016/075316 dated Feb. 8, 2017 (10 pages).

Office Action issued in China for Application No. 105133873 dated Jan. 30, 2020 (13 pages). English translation included.

English translation of the Chinese Office Action dated May 14, 2020, in Patent Application No. 201680056147.X, 5 pages.

Notice of Grounds for Rejection dated Nov. 19, 2020 in corresponding Japanese Patent Application No. 2018-520534 (with English translation)(10 pages).

* cited by examiner

AEROSOL DELIVERY SYSTEM AND METHOD OF OPERATING THE AEROSOL DELIVERY SYSTEM

This application is a U.S. National Stage Application of International Application No. PCT/EP2016/075316, filed Oct. 21, 2016, which was published in English on Apr. 27, 2017, as International Publication No. WO 2017/068100 A1. International Application No. PCT/EP2016/075316 claims priority to European Application No. 15190941.3 filed Oct. 22, 2015.

BACKGROUND

The present invention relates to an aerosol delivery system comprising an induction heating device and an aerosol-forming article, and to a method of operating the aerosol delivery system.

Previously known more conventional smoking articles, for example cigarettes, deliver flavor and aroma to the user as a result of a combustion process. A mass of combustible material, primarily tobacco, is combusted and an adjacent portion of material is pyrolized as the result of applied heat drawn therethrough, with typical combustion temperatures being in excess of 800° C. during puffing. During this heating, inefficient oxidation of the combustible material takes place and yields various distillation and pyrolysis products. As these products are drawn through the body of the smoking article towards the mouth of the user, they cool and condense to form an aerosol or vapor which gives the consumer the flavor and aroma associated with smoking.

Alternatives to the more conventional smoking articles include those in which the combustible material itself does not directly provide the flavorants to the aerosol inhaled by the smoker. In these articles, a combustible heating element, typically carbonaceous in nature, is combusted to heat air as it is drawn over the heating element and through a zone which contains heat-activated elements that release the flavored aerosol.

Yet another alternative to the more conventional smoking articles are aerosol-forming articles comprising an aerosol-forming tobacco-laden solid substrate comprising a magnetically permeable and electrically conductive susceptor which is arranged in thermal proximity to the aerosol-forming tobacco-laden substrate. The susceptor of the tobacco-laden substrate is exposed to an alternating magnetic field generated by an induction source, for example a coil, so that an alternating magnetic field is induced in the susceptor.

This induced alternating magnetic field generates heat in the susceptor, and at least some of this heat generated in the susceptor is transferred from the susceptor to the aerosol-forming substrate arranged in thermal proximity to the susceptor to produce the aerosol and evolve the desired flavor.

For that purpose, the entire tobacco-laden substrate is typically heated during the whole duration of the consuming run. Due to the tobacco flavor compounds and possibly additional other flavor compounds in the immediate spatial vicinity of the susceptor being aerosolized first (as the temperature of the tobacco-laden substrate in the immediate vicinity of the susceptor is highest) and thus being depleted first, the power supplied to the coil is typically controlled towards an increase in temperature of the susceptor over the duration of the consuming run so as to also enable aerosolization of those tobacco flavor compounds and possibly additional other flavor compounds of the tobacco-laden substrate not located in the immediate vicinity of the susceptor.

Alternatively, different segments arranged along the length of the tobacco-laden substrate are heated sequentially, so that during each puff a "fresh" (non-depleted) portion of the tobacco-laden substrate is heated. This can be achieved, for example, with the aid of a plurality of separate individual coils which are arranged along the length of a cavity accommodating a rod of a solid tobacco-laden substrate, the respective separate coils surrounding different portions of the rod of solid tobacco-laden substrate along the length of the rod of solid tobacco-laden substrate, respectively. The separate individual coils are sequentially supplied with an alternating current to sequentially generate an alternating magnetic field in the respective portion of the cavity surrounded by respective individual separate coil and, as a consequence, in the susceptor in the different segments of the rod of solid tobacco-laden substrate, thus sequentially heating the different segments of the rod of solid tobacco-laden substrate.

Due to the coils being individual separate coils the properties of the individual separate coils influencing the heating of the susceptor (e.g. inductance) may vary to some extent, so that the individual segments of the rod of tobacco-laden substrate may not be heated uniformly, which in turn may result in a non-uniform aerosolization of the tobacco flavor compounds and possibly additional flavor compounds of the tobacco-laden substrate, and thus may result in a non-uniform consuming experience. Also, the individual separate coils have to be arranged precisely axially aligned relative to each other to produce homogeneous alternating magnetic fields in the different segments of the rod of the solid tobacco-laden substrate.

In addition, the sequential heating of the individual segments requires that the individual coils be separately supplied with an alternating current to heat the individual segment surrounded by the respective individual coil. The use of only one single coil extending in length over all individual segments and surrounding all segments is not possible to achieve sequential heating of the individual segments. In addition, as the susceptor material is the same in all individual segments additional measures must be taken (magnetic shielding measures) to prevent a not-to-be-heated segment adjacently arranged to a segment to be heated from being unintentionally heated by the alternating magnetic field of the (adjacent) individual coil surrounding the segment to be heated.

Therefore, there is a need for an improved aerosol delivery system comprising an induction heating device and an aerosol-forming article comprising a susceptor, more particularly an aerosol-forming article comprising a solid aerosol-forming substrate including a susceptor.

BRIEF SUMMARY

In accordance with one aspect of the invention, an aerosol delivery system comprising an inductive heating device and an aerosol-forming article is suggested.

The aerosol-forming article comprises:

a plurality of aerosol-forming segments; and at least two different susceptors, with each aerosol-forming segment of the plurality of aerosol-forming segments comprising in the respective aerosol-forming segment at least one susceptor (and preferably only one susceptor) of the at least two different susceptors;

The inductive heating device comprises:

a device housing comprising a cavity having an internal surface shaped to accommodate at least a portion of the aerosol-forming article, the portion of the aerosol-forming article comprising at least the plurality of aerosol-forming segments;

a coil arranged to surround at least a portion of the cavity, the portion of the cavity surrounded by the coil being sized and shaped to accommodate at least the portion of the aerosol-forming article comprising the plurality of aerosol-forming segments;

an electrical power source; and a power supply electronics connected to the electrical power source and to the coil, the power supply electronics being configured to supply an alternating current to the coil to generate in the portion of the cavity surrounded by the coil an alternating magnetic field having a predetermined magnetic field strength and a predetermined frequency adapted to in at least one aerosol-forming segment of the plurality of aerosol-forming segments of the aerosol-forming article generate a thermal power which is greater than the rate of heat loss of this at least one aerosol-forming segment.

An 'aerosol-forming article' is an article which is capable of releasing volatile compounds that can form an aerosol. The aerosol-forming article may comprise an aerosol-forming part which comprises an aerosol-forming substrate. The aerosol-forming substrate is preferably a substrate which is capable of releasing volatile compounds that can form the aerosol. The volatile compounds are released by heating the aerosol-forming substrate. In a preferred embodiment, the aerosol-forming substrate is solid.

The aerosol-forming substrate may comprise nicotine. The nicotine containing aerosol-forming substrate may be a nicotine salt matrix. The aerosol-forming substrate may comprise plant-based material. The aerosol-forming substrate may comprise tobacco, and preferably the tobacco containing material contains volatile tobacco flavor compounds, which are released from the aerosol-forming substrate upon heating.

The aerosol-forming substrate may comprise homogenized tobacco material. Homogenized tobacco material may be formed by agglomerating particulate tobacco. Where present, the homogenized tobacco material may have an aerosol-former content of equal to or greater than 5% on a dry weight basis, and preferably between greater than 5% and 30% by weight on a dry weight basis.

The aerosol-forming substrate may alternatively comprise a non-tobacco-containing material. The aerosol-forming substrate may comprise homogenized plant-based material.

The aerosol-forming substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device.

Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may comprise other additives and ingredients, such as flavorants. The aerosol-forming substrate preferably comprises nicotine and at least one aerosol-former. In a particularly preferred embodiment, the aerosol-former is glycerine.

The term 'aerosol-forming segment' denotes a portion of an aerosol-forming part of the aerosol-forming article, with each such portion being capable of releasing volatile compounds that can form the aerosol upon being heated above a predetermined temperature. The aerosol-forming part of the aerosol-forming article comprises a plurality of aerosol-forming segments. The individual aerosol-forming segments of the plurality of aerosol-forming segments can be adjacently arranged in sequence one after the other along the longitudinal axis of the aerosol-forming article. However, the individual aerosol-forming segments of the plurality of segments can also be arranged differently. For example, they can be arranged coaxially, so that a centrally arranged individual aerosol-forming segment (a segment arranged directly around and including the longitudinal axis of the aerosol-forming article) is annularly surrounded by one or more different individual further aerosol-forming segments. Alternatively, the individual segments of the plurality of segments may be adjacently arranged when viewed in circumferential direction of the aerosol-forming article. For example, in case the aerosol-forming article is rod-shaped and comprises two aerosol-forming segments, each of the two aerosol-forming segments forms one half of the aerosol-forming portion of the rod-shaped aerosol-forming article (the aerosol-forming article is then separated along its longitudinal axis into two half-cylinder shaped aerosol-forming segments, for example the two aerosol-forming segments may then form an upper half cylinder and a lower half cylinder). Optionally, the individual aerosol-forming segments may be thermally separated from each other by a thermos-isolating wall.

The term 'susceptor' generally refers to a material that is capable of converting electromagnetic energy into heat. When located in an alternating electromagnetic field, typically hysteresis losses occur and eddy currents are induced in a susceptor, causing heating of the susceptor. Here, the generation of eddy currents in the susceptor is to be avoided. As the susceptor is located in thermal contact or close thermal proximity with the aerosol-forming substrate, the aerosol-forming substrate is heated by the respective susceptor such that an aerosol is formed. Preferably, the susceptor is arranged in direct physical contact with the susceptor.

The susceptor generally may be formed from any material that can be inductively heated to a temperature sufficient to aerosolize the aerosol-forming substrate without eddy currents being generated. For example, a susceptor may comprise ferrite. Preferred susceptors may be heated to a temperature in excess of 250 degrees Celsius.

A susceptor may have a protective external layer, for example a protective ceramic layer or protective glass layer encapsulating the susceptor. The susceptor may comprise a protective coating formed by a glass or by a ceramic, formed over a core of susceptor material.

Preferred susceptors are made of an electrically non-conductive material. For example, the electrically non-conductive material is a ferrimagnetic ceramic material, such as a ferrite. In electrically non-conductive ceramic materials no eddy currents are induced by the alternating magnetic field (due to the materials being electrically non-conductive). In addition, in ferrimagnetic materials the hysteresis losses disappear at the Curie-temperature of the respective ferrimagnetic material.

The susceptor may comprise an elongate material. The susceptor may also comprise particles, for example ferrite particles. In case the susceptor is in the form of a plurality of particles, preferably the particles are homogeneously distributed in the aerosol-forming substrate. Preferably, the susceptor particles have sizes in a range of 5 micrometers to 100 micrometers, more preferably in a range of 10 micrometers to 80 micrometers, for example between 20 micrometers and 50 micrometers.

The susceptor may be solid, hollow or porous. Preferably, the susceptor is solid. The susceptor may have continuous profile which is a filament, a rod, a sheet or a band.

If the susceptor profile is of constant cross-section, for example circular cross-section, it has a preferable width or diameter of between 1 millimeter and 5 millimeters. If the susceptor profile has the form of a sheet or band, the sheet or band preferably has a rectangular shape having a width preferably between 2 millimeters and 8 millimeters, more preferably between 3 millimeters and 5 millimeters, for example 4 millimeters, and has a thickness preferably between 0.03 millimeter and 0.15 millimeter, more preferably between 0.05 millimeter and 0.09 millimeter, for example 0.07 millimeter.

'Different susceptors' are susceptors that have a different hysteresis loop area in the B-H-diagram (magnetic flux density B over the magnetic field H). The aerosol-forming article comprises at least two different susceptors, that is to say two or more different susceptors.

Each of the aerosol-forming segments of the plurality of segments comprises in the respective aerosol-forming segment at least one susceptor, and preferably only one susceptor, of the at least two different susceptors. This includes cases in which each individual aerosol-forming segment of the plurality of aerosol-forming segments comprises a unique susceptor, but also includes cases in which some of the individual aerosol-forming segments of the plurality of aerosol-forming segments comprise the same susceptor while other aerosol-forming segments of the aerosol-forming segments comprise a different susceptor.

The inductive heating device comprises a device housing comprising a cavity, and the cavity of the device housing has an internal surface which is shaped to accommodate at least the part or portion of the aerosol-forming article comprising the plurality of aerosol-forming segments. However, optionally the cavity may accommodate additional parts or portions of the aerosol-forming article.

The 'coil' which is arranged to surround that portion of the cavity in which the part or portion of the aerosol-forming article is arranged which comprises the aerosol-forming segments may generally be embodied as comprising one or more individual coils, but preferably is embodied as a single coil only.

The electrical power source generally may comprise any suitable power source including in particular a power supply unit to be connected to the mains, one or more single-use batteries, rechargeable batteries, or any other suitable power source capable of providing the required supply voltage and the required supply amperage. In particular, the power source may comprise rechargeable batteries.

The power supply electronics is connected to both the electrical power source and to the coil. The power supply electronics is configured to supply an alternating current to the coil to generate in the portion of the cavity surrounded by the coil an alternating magnetic field having a magnetic field strength and a frequency that can be calculated from the amplitude and frequency of the alternating current supplied to the coil, the number of windings of the coil, the length of the coil, etc., as this is well-known in the art.

While generally the power supply electronics can be embodied in any suitable manner, it typically may comprise a microcontroller for controlling the amperage, frequency, duration, etc. of the alternating current supplied to the coil. Preferably, the frequency of the alternating current (and thus the frequency of the alternating magnetic field) may be in a range of 5 MHz to 12 MHz.

For the sake of simplicity, in the following it is assumed that only hysteresis losses are generated in the susceptor as the susceptor is exposed to the alternating magnetic field (no eddy current losses).

The heat generated in the susceptor during one cycle of the alternating magnetic field corresponds to the hysteresis loop area of the respective susceptor in the B-H diagram. The higher the amplitude of the alternating current (i.e. the higher the magnetic field strength), the larger is the hysteresis loop area, as long as the amplitude of the alternating current is selected such that the magnetic field strength does not cause saturation in the susceptor, since in this case a further increase of the amplitude of the alternating current does no longer lead to an increase of the hysteresis loop area.

The total thermal power (per unit of time) generated in the susceptor thus is proportional to the mathematical product of the frequency and the heat generated during one cycle, and can be thus be controlled by the amplitude of the alternating current supplied to the coil on one hand, and by the frequency of the alternating current on the other hand.

On the other hand, there is rate of heat loss (per unit of time) to the ambient for each of the aerosol-forming segments. However, as long as the thermal power (per unit of time) generated in the susceptor is greater than the rate of heat loss (per unit of time) the temperature of the susceptor increases. In case the rate of heat loss is greater than the thermal power generated, the temperature of the susceptor decreases. In case the rate of heat loss and the thermal power generated are equal, the temperature of the susceptor does not change.

Accordingly, as each aerosol-forming segment of the plurality of aerosol-forming segments preferably comprises only one susceptor, it is possible to control the heating up of the different susceptors such, that the temperature of one susceptor of the at least two susceptors is increased (i.e. the susceptor is heated) while the temperature of the other susceptors of the at least two susceptors is not increased. This allows for a selective heating of individual segments of the plurality of segments.

For example, in case the total number of different susceptors is two (a first susceptor and a second susceptor) and there is a total number of four aerosol-forming segments, with two of the four aerosol-forming segments comprising the first susceptor and the other two of the four aerosol-forming segments comprising the second susceptor, it is then possible to first supply an alternating current to the coil generating an alternating magnetic field having a magnetic field strength and a frequency to first heat the two aerosol-forming segments comprising the first susceptor while the two aerosol-forming segments comprising the second susceptor are not heated. After a predetermined period of time, an alternating current is supplied to the coil generating an alternating magnetic field having a different field strength and/or a different frequency to heat the two aerosol-forming segments comprising the second susceptor while the two aerosol-forming segments comprising the first susceptor are no longer heated.

Thus, it is more or less possible to achieve any desired sequence of heating aerosol-forming segments. For example, the individual aerosol-forming segments of the plurality of aerosol-forming segments can be heated sequentially, one after the other, so that only one segment is heated at a time. Alternatively, it is possible to simultaneously heat two or more segments at a time (these segments may then comprise the same susceptor). Also, it is within the scope of the invention that some or all of the plurality of aerosol-forming segments comprise different susceptors which can be heated simultaneously with the aid of an alternating magnetic field of predetermined field strength and frequency. In this case, the susceptors must be selected such that at the said predetermined field strength and frequency of the alternating magnetic field the different susceptors are all heated, whereas at a magnetic field strength and/or frequency other than said predetermined magnetic field strength and/or frequency only one susceptor of the at least two susceptors is heated while the other susceptors of the at least two susceptors are not heated. Some of the various options of heating the individual aerosol-forming segments are discussed in more detail below. The result is a uniform aerosolization of the tobacco flavor compounds and possibly additional flavor compounds during the consuming run, which in turn results in a uniform consuming experience.

The inductive heating device of the aerosol delivery system according to the invention may or may not comprise a mouthpiece. For example, in case the inductive heating device does not comprise a mouthpiece, the aerosol-forming substrate may be embodied as a rod-shaped solid tobacco-laden substrate which is provided with a filter. The rod-shaped solid tobacco-laden substrate (including the plurality of segments comprising the at least two susceptors) may be inserted in the cavity of the device with the filter projecting outward from the cavity, so that during the consuming run the consumer may draw at the filter end of the substrate. Alternatively, the device may comprise a mouthpiece, and in this case the aerosol-forming substrate may be fully enclosed by the inductive heating device, so that during the consuming run the consumer may draw at the mouthpiece. Any of these embodiments (with or without mouthpiece) is considered to be within the scope of the invention.

As already mentioned, in accordance with one aspect of the aerosol delivery system according to the invention, the at least two different susceptors are preferably made of a ferrimagnetic, electrically non-conductive material. In particular, this ferrimagnetic, electrically non-conductive material may be a ceramic material. Even more particular, the ceramic material may be ferrite. The advantage of such materials is that no eddy currents are produced (as these materials are electrically non-conductive) so that the amount of heat generated can be controlled based on the hysteresis losses only which disappear at a predefined Curie temperature of a specific susceptor material.

In accordance with a further aspect of the aerosol delivery system according to the invention, the power supply electronics is configured to supply the alternating current to the coil such that the alternating magnetic field having the predetermined magnetic field strength and the predetermined frequency is adapted to in a single aerosol-forming segment of the plurality of aerosol-forming segments generate a thermal power which is greater than the rate of heat loss of the single aerosol-forming segment, and that the alternating magnetic field is further adapted to at the same time generate in each aerosol-forming segment other than the single aerosol-forming segment a thermal power which is smaller than the rate of heat loss of the respective other aerosol-forming segment. This allows to individually heat only one single aerosol-forming segment while all other aerosol-forming segments are not heated.

In accordance with a further aspect of the aerosol delivery system according to the invention, the power supply electronics is configured to supply the alternating current to the coil such that during a first period of time the alternating magnetic field has a first predetermined magnetic field strength and a first predetermined frequency adapted to in the single aerosol-forming segment generate a thermal power which is greater than the rate of heat loss of the single aerosol-forming segment. The power supply is further configured to supply the alternating current to the coil such that during a second period of time subsequent to the first period of time the alternating magnetic field has a second predetermined magnetic field strength and a second predetermined frequency different from the first predetermined magnetic field strength and the first predetermined frequency, the alternating magnetic field having the second predetermined magnetic field strength and the second predetermined frequency being adapted to in a further single aerosol-forming segment different from the single aerosol-forming segment generate a thermal power which is greater than the rate of heat loss of the further single aerosol-forming segment. This allows for heating the first aerosol-forming segment during the first period of time and thereafter heating the second aerosol-forming segment during the second period of time. This sequence can be extended to additional aerosol-forming segments, so that each of the individual aerosol-forming segments of the plurality of segments can be heated one after the other.

In accordance with a further aspect of the aerosol delivery system according to the invention, the power supply electronics is configured to supply the alternating current to the coil such that the alternating magnetic field having the predetermined magnetic field strength and the predetermined frequency is adapted to in a first aerosol-forming segment of the plurality of aerosol-forming segments generate a thermal power which is greater than the rate of heat loss of the first aerosol-forming segment, and that the alternating magnetic field having the predetermined magnetic field strength and the predetermined frequency is further adapted to at the same time generate in at least one further aerosol-forming segment different from the first aerosol-forming segment a thermal power which is greater than the rate of heat loss of the at least one further aerosol-forming segment. This allows for heating two or more aerosol-forming segments of the plurality of aerosol-forming segments at the same time in case the alternating magnetic field has the predetermined magnetic field strength and frequency, as only at this predetermined magnetic field strength and frequency the different susceptors can be heated simultaneously (given that the susceptor materials of the different susceptors are selected to allow for such simultaneous heating of the different susceptor materials at the predetermined magnetic field strength and frequency). At a magnetic field strength and/or frequency other than the predetermined field strength and/or frequency the different susceptor materials may not be heated simultaneously.

Another general aspect of the invention relates to a method of operating the aerosol delivery system according to the invention. The method comprises the steps of:

providing an aerosol delivery system according to the invention;

inserting at least a portion of the aerosol-forming article into the cavity of the device housing such that the plurality of aerosol-forming segments comprising the at least two different susceptors are surrounded by the coil;

generating in at least one of the aerosol-forming segments of the plurality of aerosol-forming segments a thermal power which is greater than the rate of heat loss of the at least one aerosol-forming segment with the aid of the power supply electronics supplying an alternating current to the coil generating in the portion of the cavity surrounded by the coil an alternating magnetic field having a predetermined magnetic field strength and a predetermined frequency.

In accordance with one aspect of the method according to the invention, the step of providing the aerosol delivery system comprises providing an aerosol-forming article in which the at least two different susceptors are made of an electrically non-conductive material.

In accordance with a further aspect of the method according to the invention, the electrically non-conductive material is a ferrimagnetic ceramic material.

In accordance with still a further aspect of the method according to the invention, the ferrimagnetic ceramic material is a ferrite.

According to yet another aspect of the method according to the invention, the method comprises with the aid of the alternating magnetic field having the predetermined magnetic field strength and the predetermined frequency generating in a single aerosol-forming segment of the plurality of aerosol-forming segments a thermal power which is greater than the rate of heat loss of the single aerosol-forming segment, while at the same time with the aid of the alternating magnetic field having the predetermined magnetic field strength and the predetermined frequency generating in each aerosol-forming segment other than the single aerosol-forming segment a thermal power which is smaller than the rate of heat loss of the respective other aerosol-forming segment.

According to still a further aspect of the method according to the invention, the method comprises during a first period of time with the aid of the alternating magnetic field having a first predetermined magnetic field strength and a first predetermined frequency generating in the single aerosol-forming segment a thermal power which is greater than the rate of heat loss of the single aerosol-forming segment, and during a second period of time subsequent to the first period of time with the aid of the alternating magnetic field having a second predetermined magnetic field strength and a second predetermined frequency generating in a further single aerosol-forming segment a thermal power which is greater than the rate of heat loss of the further single aerosol-forming segment.

In accordance with another aspect of the method according to the invention, the method comprises with the alternating magnetic field having the predetermined field strength and the predetermined frequency generating in a first aerosol-forming segment of the plurality of aerosol-forming segments a thermal power which is greater than the rate of heat loss of the first aerosol-forming segment, and with the alternating magnetic field having the predetermined magnetic field strength and the predetermined frequency at the same time generate in at least one further aerosol-forming segment different from the first aerosol-forming segment a thermal power which is greater than the rate of heat loss of the at least one further aerosol-forming segment.

As the advantages of the various aspects have already been discussed above in connection with the aerosol delivery system according to the invention, it is referred to this discussion above.

BRIEF DESCRIPTION OF THE DRAWINGS

Further advantageous aspects of the invention become apparent from the following description of embodiments of the invention with the aid of the drawings in which.

DETAILED DESCRIPTION

Figure 1:
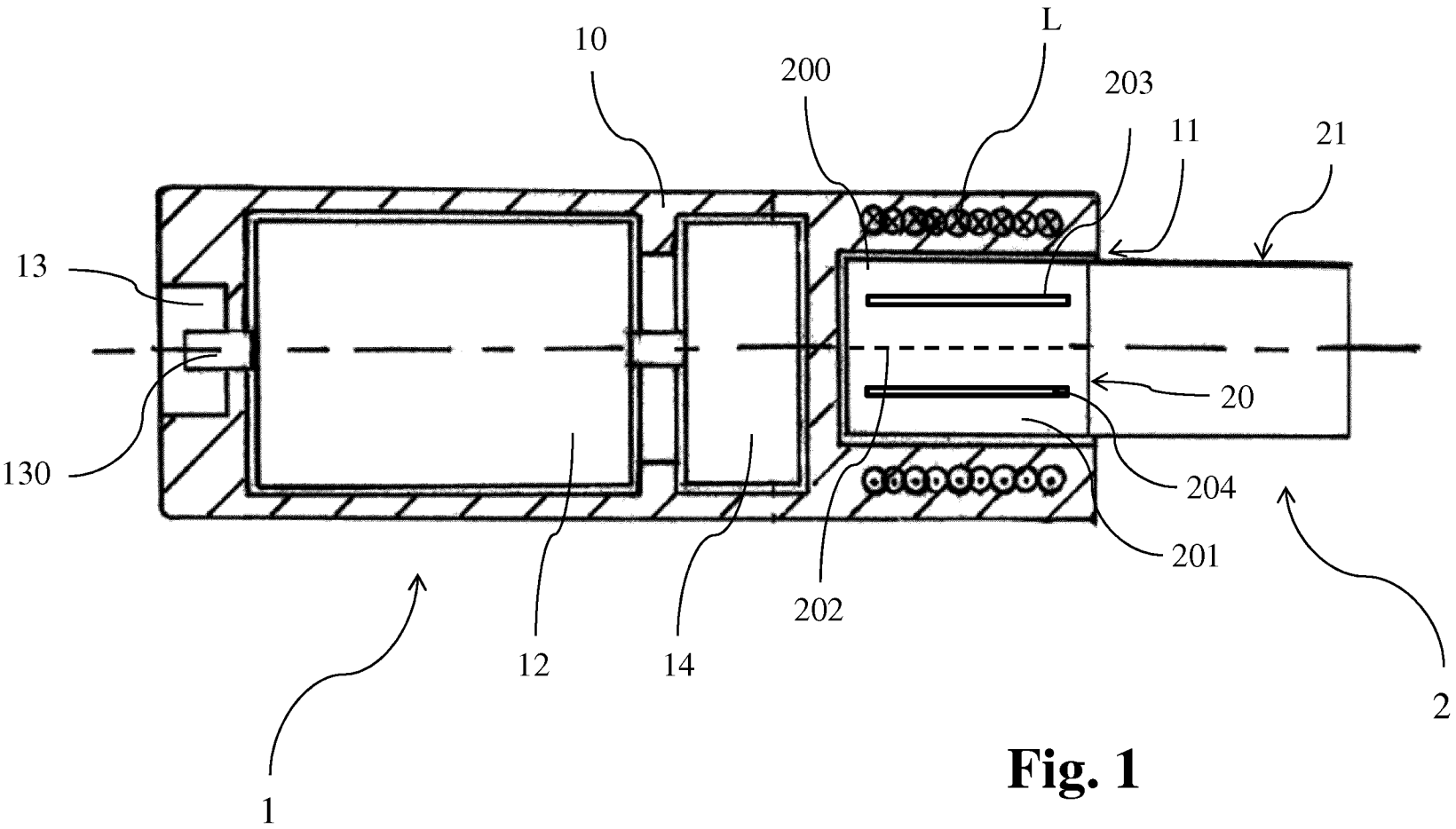
FIG. 1 shows a first embodiment of an aerosol delivery system according to the invention.

FIG. 1 shows a first embodiment of an aerosol delivery system according to the invention comprising an inductive heating device 1 and an aerosol-forming article 2 arranged in a cavity 11 of the device housing 10 of the inductive heating device 1. As shown in FIG. 1, the aerosol-forming article 2 may comprise a portion 20 comprising a first aerosol-forming segment 200 and a second aerosol-forming segment 201. Any number of aerosol-forming segments higher than two is generally possible, however, for the sake of simplicity only the first aerosol-forming segment 200 and the second aerosol-forming segment 201 are shown. Also, in the embodiment of the aerosol delivery system shown in FIG. 1 the first aerosol-forming segment 200 and the second aerosol-forming 201 are arranged to form an upper half and lower half of the (aerosol-forming) portion 20 of the aerosol-forming article 2, and the first aerosol-forming segment 200 and the second aerosol-forming segment 201 are thermally separated from each other by a thermo-insulating wall 202 (such as, for example, a thermo-insulating foil) indicated in FIG. 1 by the dashed line. And while the arrangement shown in FIG. 1 is one possible arrangement of the aerosol-forming segments, other arrangements of the aerosol-forming segments are possible. For example, the aerosol-forming segments may be embodied as cylindrical segments which are sequentially arranged one after the other along the longitudinal axis of the aerosol-forming article (with or without thermo-insulating wall arranged between adjacently arranged aerosol-forming segments).

Each of the first aerosol-forming segment 200 and the second aerosol-forming segment 201 may comprise a solid tobacco-laden substrate. In the first aerosol-forming segment 200 there is arranged a first ferrimagnetic susceptor 203, and in the second aerosol-forming segment 201 there is arranged a second ferrimagnetic susceptor 204 different from the first ferrimagnetic susceptor 203. The first and second susceptors may have the shape of a small blade or strip, but may also be present in the form of particles or in any other suitable form. The first and second ferrimagnetic susceptors may be made of a ceramic material such as a ferrite, so that they are electrically non-conductive.

Inductive heating device 1 of the embodiment of the aerosol delivery system shown in FIG. 1 further comprises a helically wound inductor coil L which is arranged to surround cavity 11 to be capable of inducing an alternating magnetic field within cavity 11.

Inductive heating device 1 further comprises an electrical power source 12, which may be a DC power source such as a battery (e.g. a rechargeable battery). A docking port 13 comprising a pin 130 for recharging the battery is also indicated in FIG. 1 by way of example.

Inductive heating device 1 further comprises a power supply electronics 14 connected to the electrical power source 12 (rechargeable battery) on one hand and to coil L on the other hand. Power supply electronics 14 is capable of supplying an alternating current to coil L. The electrical connections to coil L are arranged within device housing 10 and are not shown in FIG. 1 for the sake of simplicity. The power supply electronics 14 may typically comprise a microcontroller unit (not shown in detail) which may control the amplitude and frequency of the alternating current supplied to the coil L.

Figure 2:
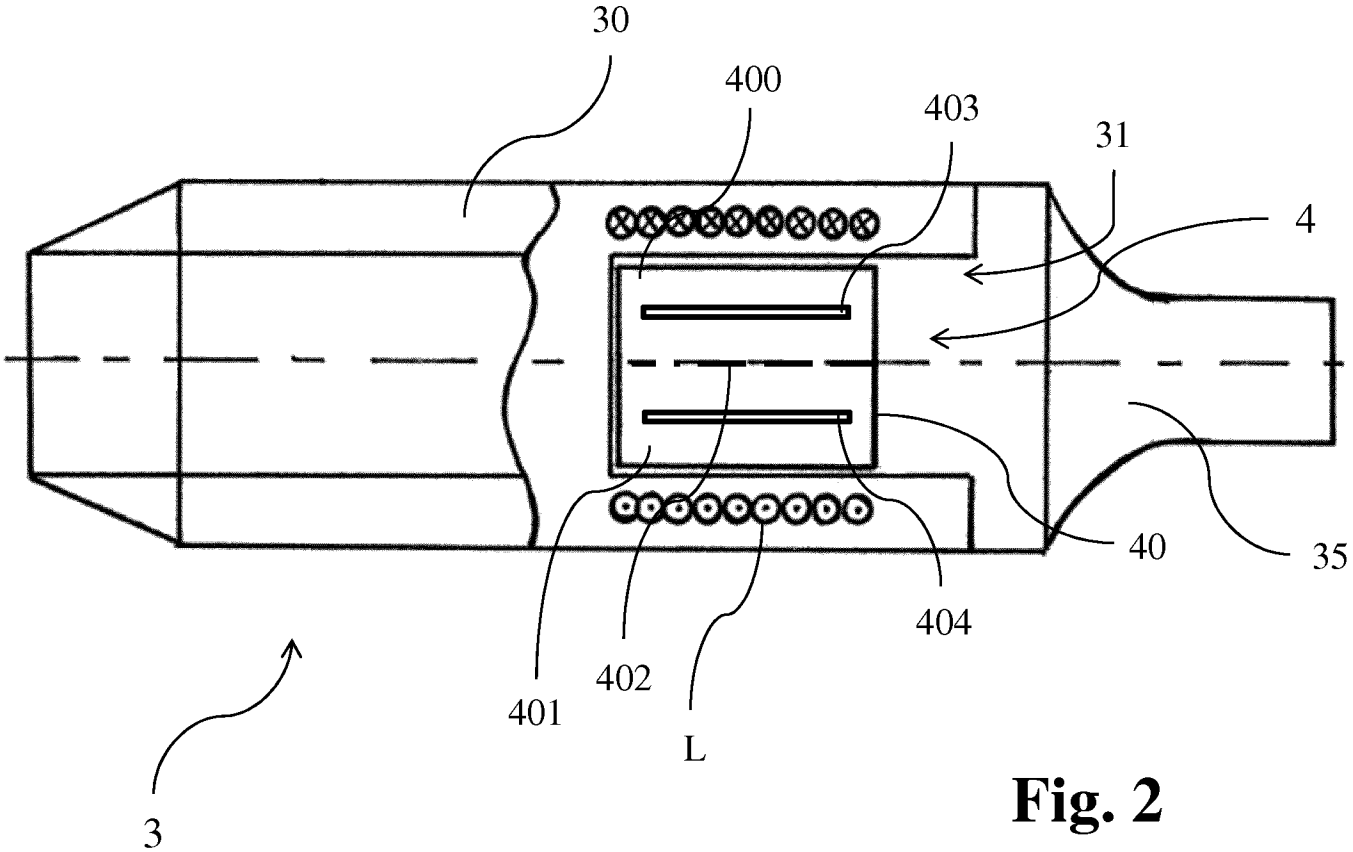
FIG. 2 shows a second embodiment of an aerosol delivery system according to the invention.

FIG. 2 shows a further embodiment of the aerosol delivery system according to the invention comprising an inductive heating device 3 and an aerosol-forming article 4. However, FIG. 2 only very schematically shows this further embodiment of the aerosol delivery system, as many components that have been described in connection with the embodiment of FIG. 1 can be present in the embodiment of FIG. 2 as well, so that they need not be described in detail again. An essential difference of the embodiment shown in FIG. 2 vis-a-vis the embodiment shown in FIG. 1 is that the inductive heating device 3 of the embodiment of the aerosol delivery system shown in FIG. 2 comprises a mouthpiece 35 whereas the inductive heating device of the embodiment of FIG. 1 does not comprise such mouthpiece. Inductive heating device 3 comprises a device housing 30 comprising a cavity 31 in which an aerosol-forming article 4 is arranged. The aerosol-forming article 4 of this embodiment comprises only a portion 40 comprising a first aerosol-forming segment 400 and a second aerosol-forming segment 401 separated by a thermo-insulating wall 402 (indicated again by the dashed line), with a first susceptor 403 being arranged in the first aerosol-forming segment 400 and with a second susceptor 404 different from the first susceptor 403 being arranged in the second aerosol-forming segment 401. The inductive heating device 3 of the embodiment of the aerosol delivery system shown in FIG. 2 further comprises the coil L which is again arranged to surround cavity 31 to in operation generate an alternating magnetic field in cavity 31 where the aerosol-forming article is arranged.

With the aid of FIG. 3 through FIG. 7 the operation of the aerosol delivery system according to the invention will now be described.

Figure 3:
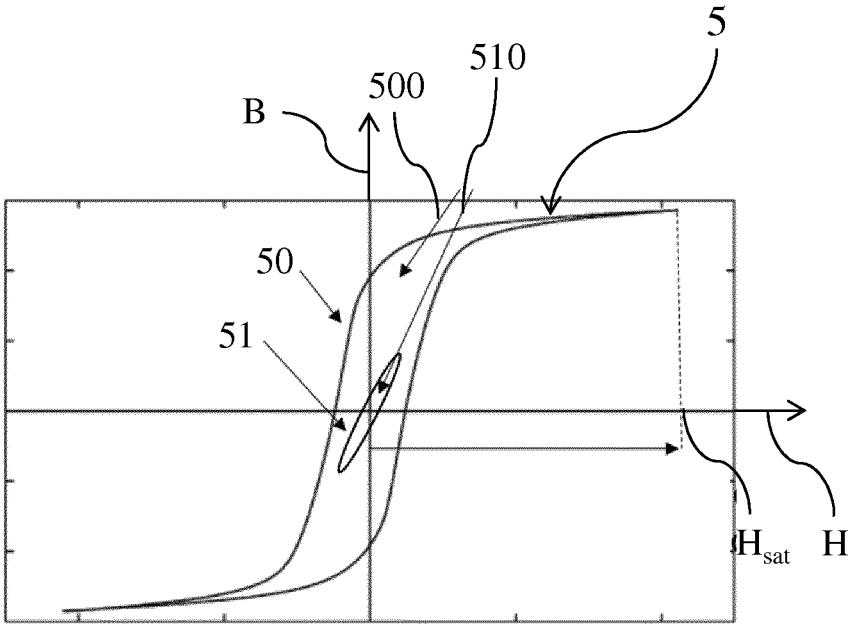
FIG. 3 shows a B-H diagram of a ferrimagnetic susceptor.

In FIG. 3 a B-H-diagram of a susceptor made of a ferrimagnetic material such as a ferrite is shown (with B representing the magnetic flux density and H representing the magnetic field strength causing the magnetic flux density B). The graph 5 illustrates the well-known hysteresis loop. The area bounded by the outermost lines 50 of the graph 5 is representative of the maximum hysteresis which can be caused by an alternating magnetic field for this specific susceptor. The smaller inner curve 51 of the graph 5 is representative of the hysteresis caused by an alternating magnetic field having a magnetic field strength which is smaller than the magnetic field strength of the alternating magnetic field that causes the maximum possible hysteresis.

Figure 4:
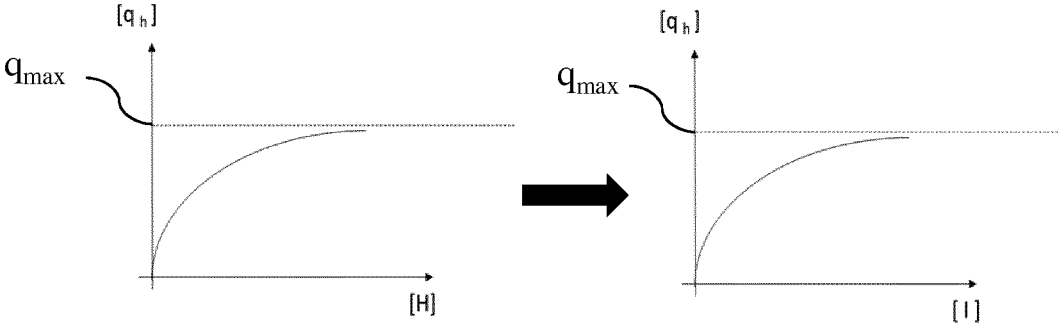
FIG. 4 shows diagrams representing the heat generated in the susceptor over the magnetic field strength H of an alternating magnetic field of a coil, and over the alternating current flowing through the said coil to generate the alternating magnetic field.

The amount of heat $q_h(H)$ (for example measured in Joule) generated in the susceptor due to hysteresis losses during one cycle of the alternating magnetic field increases as the area 500 or 510, respectively, of the respective hysteresis loop caused by the alternating magnetic field increases (actually, the area 500 represents the maximum area possible and thus is representative of the maximum hysteresis loss possible during once cycle of the alternating magnetic field). In this regard, it is to be mentioned again that due to the susceptor being made of an electrically non-conductive material no eddy currents are generated and, consequently, there is no heat loss caused by eddy currents. However, once saturation occurs (at a magnetic field strength $H_{sat}$ which does not result in a further increase of the magnetic flux density B) the area of the hysteresis loop is not increased anymore even in case the magnetic field strength would be higher than $H_{sat}$. Accordingly, the maximum amount of heat $q_{max}$ (H) that can be generated in the susceptor during one cycle of the alternating magnetic field cannot increase above $q_{max}$ (H). This becomes evident from the diagram on the left hand side of FIG. 4 showing the heat $q_h$ over the magnetic field strength H of the alternating magnetic field.

As has been discussed further above, the alternating magnetic field is generated by an alternating current I flowing through the coil L. As the magnetic field strength H of the alternating magnetic field generated by an alternating current I flowing through the coil is directly proportional to that alternating current I, the amount of heat $q_h$ generated in the susceptor during one cycle of the alternating magnetic increases in the same manner, as shown in the diagram $q_h$ over I on the right hand side of FIG. 4.

Figure 5:
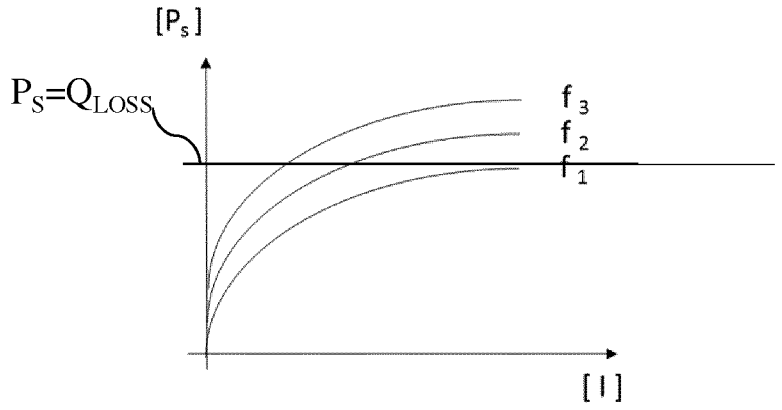
FIG. 5 shows the thermal power generated in the susceptor over the alternating current flowing through the coil.

This means that the thermal power $P_S$ (the total amount of heat generated per unit of time, for example per second) generated in the susceptor increases as the frequency f of the alternating magnetic field (or of the alternating current I flowing through the coil L) increases, as is evident from the diagram in FIG. 5 showing the thermal power $P_S$ over the alternating current I at different frequencies $f_1$, $f_2$, $f_3$, with $f_1$ being lower than $f_2$, and with $f_2$ being lower than $f_3$ ($f_1<f_2<f_3$). As mentioned further above, the frequencies $f_1$, $f_2$ and $f_3$ are preferably in the range of 5 MHz to 12 MHz.

On the other hand, at an elevated temperature of the aerosol-forming segment (i.e. at a temperature above the temperature of the ambient) there is heat loss of the aerosol-forming segment to the ambient due to convective and diffusive heat loss. If the rate $Q_{LOSS}$ of heat loss to the ambient (the amount of heat lost to the ambient per unit of time, for example per second) is greater/higher than the thermal power $P_S$ (the amount of heat generated in the susceptor of the segment per same unit of time, for example per second) caused by the hysteresis losses, then the temperature of the aerosol-forming segment decreases. If the rate $Q_{LOSS}$ is smaller than the thermal power $P_S$, the temperature of the aerosol-forming segment increases, the aerosol-forming segment is further heated. And in case the rate $Q_{LOSS}$ is equal to the thermal power $P_S$ the temperature of the aerosol-forming segment is kept constant and neither increases nor decreases.

A line indicated "$P_S=Q_{LOSS}$" where the thermal power $P_S$ and the rate $Q_{LOSS}$ are equal for the specific susceptor is shown in FIG. 5. Accordingly, at a frequency $f_1$ no further heating of the aerosol-forming segment is possible (regardless of the amplitude of the alternating current I) as in any event the thermal power $P_S$ is smaller than the rate $Q_{LOSS}$ of heat loss, whereas at frequencies $f_2$ and $f_3$ further heating of the susceptor and the aerosol-forming segment is possible by increasing the amplitude of the alternating current I flowing through the coil L and generating an increased magnetic field strength H of the alternating magnetic field.

Figure 6:
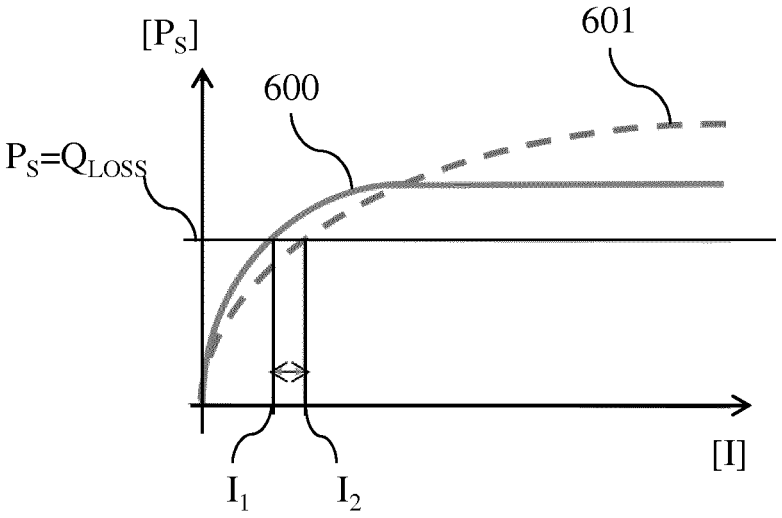
FIG. 6 shows the thermal power and heat loss of the aerosol delivery system according to the invention in a first operating mode at low alternating current amplitude and high frequency.

In FIG. 6 a first operating mode of the aerosol delivery system according to the invention is shown, in which the alternating magnetic field to which the two different susceptors arranged in the two different aerosol-forming segments (only one type of susceptor being arranged in each of the two aerosol-forming segments) are simultaneously exposed. In this first mode of operation the amplitude of the alternating current I is low while the predetermined frequency f is high. The frequency f is selected such that the condition $f \cdot q_{max1} > Q_{LOSS}$ (which means $P_{S1} > Q_{LOSS}$) can be fulfilled. Similar to FIG. 5, the line $P_S = Q_{LOSS}$ is indicated in the diagram in FIG. 6. Let us assume that the continuous line 600 in FIG. 6 represents the thermal power generated in the first susceptor while the dashed line 601 represents the thermal power generated in the second susceptor. Accordingly, continuous line 600 indicates that the first susceptor exhibits a sharper rise of thermal power but a lower maximum thermal power than the second susceptor (see dashed line 601). Or to say it in other words, the first susceptor has a lower saturation limit of hysteresis heat $q_{max}$ than the second susceptor but has a higher initial increase rate—increase rate starting at zero—as a function of the amplitude of the alternating current I through the coil L.

Accordingly, in this first mode of operation at the predetermined high frequency f the amplitude of the alternating current I is selected from the range bounded by $I_1$ and $I_2$ in FIG. 6. $I_1$ is selected such that at the predetermined high frequency f the condition $Q_{LOSS} = f \cdot q_{max1}$ is fulfilled. $I_2$ is selected in a manner such that the condition $Q_{LOSS} = f \cdot q_{max2}$ is fulfilled. If the amplitude I of the alternating current is selected from this range, then the first susceptor (and, accordingly, the first aerosol-forming segment) is heated since for amplitudes I from this range the thermal power $P_{S1}$ of the first susceptor according to continuous line 600 is higher than the rate of heat loss $Q_{LOSS}$ and, accordingly, the first susceptor is heated. At the same time the thermal power $P_{S2}$ of the second susceptor according to dashed line 601 is lower than the rate of heat loss $Q_{LOSS}$. and therefore the second susceptor (and, accordingly, the second aerosol-forming segment) is not heated but rather the temperature of the second susceptor decreases.

Figure 7:
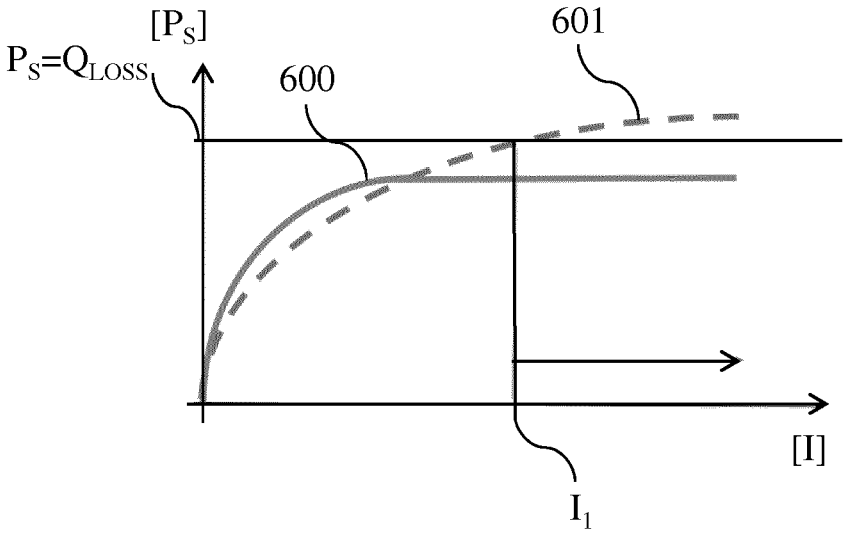
FIG. 7 shows the thermal power and heat loss of the aerosol delivery system according to the invention in a second operating mode at high alternating current amplitude and low frequency.

In FIG. 7 a second operating mode of the aerosol delivery system according to the invention is shown, in which the alternating magnetic field to which the two different susceptors arranged in the two different aerosol-forming segments (only one type of susceptor being arranged in each of the two aerosol-forming segments) are simultaneously exposed. In this second mode of operation the amplitude of the alternating current I is high while the predetermined frequency f is low. The frequency f is selected such that the condition $f \cdot q_{max1} < Q_{LOSS} < f \cdot q_{max2}$ can be fulfilled (which means $P_{S1} < Q_{LOSS} < P_{S2}$). The line $P_S = Q_{LOSS}$ is indicated in the diagram in FIG. 7, too. In this mode of operation at the predetermined low frequency f the amplitude of the alternating current I is selected to be higher than $I_1$. $I_1$ is selected such that the condition $Q_{LOSS} = f \cdot q_2(I_1)$ is fulfilled. If the amplitude I of the alternating current is selected to be higher than $I_1$, then the second susceptor (and, accordingly, the second aerosol-forming segment) is heated since for amplitudes higher than $I_1$ the thermal power $P_{S2}$ of the second susceptor according to dashed line 601 is higher than the rate of heat loss $Q_{LOSS}$ and, accordingly, the second susceptor is heated. At the same time the thermal power $P_{S1}$ of the first susceptor according to continuous line 600 is lower than the rate of heat loss $Q_{LOSS}$ and therefore the first susceptor (and, accordingly, the first aerosol-forming segment) is not heated but rather the temperature of the first susceptor decreases.

It is thus possible through controlling the amplitude and frequency of the alternating current flowing through the coil to selectively heat only one of the two aerosol-forming segments.

While the invention has been explained with the aid of embodiments shown in the drawings, it is clear to the person skilled in the art that various modifications and changes can be made without departing from the teaching underlying the invention. Only by way of example, it should be mentioned that a different arrangement of the individual segments is possible, and that a higher number of different segments and different susceptors is possible, too. However, many other changes and modification are possible and covered by the teaching underlying the invention, so that the scope of protection is not limited to the embodiments described but rather is defined by the appended claims.

The invention claimed is:

1. An aerosol delivery system comprising:

an inductive heating device and an aerosol-forming article, the aerosol-forming article comprising:

a plurality of aerosol-forming segments; and at least two different susceptors, the at least two different susceptors having a different hysteresis loop area in a B-H-diagram, with each aerosol-forming segment of the plurality of aerosol-forming segments comprising in the respective aerosol-forming segment at least one susceptor of the at least two different susceptors; wherein the at least two different susceptors are thermally separated from each other by a thermo-insulating wall extending between the at least two different susceptors in an axial direction of the aerosol delivery system;

the inductive heating device comprising:

a device housing comprising a cavity having an internal surface shaped to accommodate at least a portion of the aerosol-forming article, the portion of the aerosol-forming article comprising at least the plurality of aerosol-forming segments;

only one single coil, the single coil being arranged to completely surround a circumference of the cavity, a portion of the cavity completely surrounded by the single coil along the circumference of the cavity being sized and shaped to accommodate at least the portion of the aerosol-forming article comprising the plurality of aerosol-forming segments;

an electrical power source; and a power supply electronics connected to the electrical power source and to the single coil, the power supply electronics being configured to supply an alternating current to the single coil to generate in the portion of the cavity completely surrounded by the single coil along the circumference of the cavity an alternating magnetic field having a predetermined magnetic field strength and a predetermined frequency adapted to in at least one aerosol-forming segment of the plurality of aerosol-forming segments of the aerosol-forming article generate a thermal power which is greater than the rate of heat loss of this at least one aerosol-forming segment.

2. The aerosol delivery system according to claim 1, wherein the at least two different susceptors are made of an electrically non-conductive material.

3. The aerosol delivery system according to claim 2, wherein the electrically non-conductive material is a ferrimagnetic ceramic material.

4. The aerosol delivery system according to claim 3, wherein the ferrimagnetic ceramic material is a ferrite.

5. The aerosol delivery system according to claim 1, wherein the power supply electronics is configured to supply the alternating current to the single coil such that the alternating magnetic field having the predetermined magnetic field strength and the predetermined frequency is adapted to in a single aerosol-forming segment of the plurality of aerosol-forming segments generate a thermal power which is greater than the rate of heat loss of the single aerosol-forming segment, and that the alternating magnetic field is further adapted to at the same time generate in each aerosol-forming segment other than the single aerosol-forming segment a thermal power which is smaller than the rate of heat loss of the respective other aerosol-forming segment.

6. The aerosol delivery system according to claim 5, wherein the power supply electronics is configured to supply the alternating current to the single coil such that during a first period of time the alternating magnetic field has a first predetermined magnetic field strength and a first predetermined frequency adapted to in the single aerosol-forming segment generate a thermal power which is greater than the rate of heat loss of the single aerosol-forming segment, and wherein the power supply is further configured to supply the alternating current to the single coil such that during a second period of time subsequent to the first period of time the alternating magnetic field has a second predetermined magnetic field strength and a second predetermined frequency different from the first predetermined magnetic field strength and the first predetermined frequency, the alternating magnetic field having the second predetermined magnetic field strength and the second predetermined frequency being adapted to in a further single aerosol-forming segment different from the single aerosol-forming segment generate a thermal power which is greater than the rate of heat loss of the further single aerosol-forming segment.

7. The aerosol delivery system according to claim 1, wherein the power supply electronics is configured to supply the alternating current to the single coil such that the alternating magnetic field having the predetermined magnetic field strength and the predetermined frequency is adapted to in a first aerosol-forming segment of the plurality of aerosol-forming segments generate a thermal power which is greater than the rate of heat loss of the first aerosol-forming segment, and that the alternating magnetic field having the predetermined magnetic field strength and the predetermined frequency is further adapted to at the same time generate in at least one further aerosol-forming segment different from the first aerosol-forming segment a thermal power which is greater than the rate of heat loss of the at least one further aerosol-forming segment.

8. A method of operating an aerosol delivery system, the method comprising:

providing the aerosol delivery system according to claim 1;

inserting at least a portion of the aerosol-forming article into the cavity of the device housing such that the plurality of aerosol-forming segments comprising the at least two different susceptors are completely surrounded by the single coil;

generating in at least one of the aerosol-forming segments of the plurality of aerosol-forming segments a thermal power which is greater than the rate of heat loss of the at least one aerosol-forming segment with the aid of the power supply electronics supplying an alternating current to the single coil generating in the portion of the cavity completely surrounded by the single coil along the circumference of the cavity an alternating magnetic field having a predetermined magnetic field strength and a predetermined frequency.

9. The method according to claim 8, wherein the step of providing the aerosol delivery system comprises providing an aerosol-forming article in which the at least two different susceptors are made of an electrically non-conductive material.

10. The method according to claim 9, wherein the electrically non-conductive material is a ferrimagnetic ceramic material.

11. The method according to claim 10, wherein the ferrimagnetic ceramic material is a ferrite.

12. The method according to claim 8, wherein the method comprises with the aid of the alternating magnetic field having the predetermined magnetic field strength and the predetermined frequency generating in a single aerosol-forming segment of the plurality of aerosol-forming segments a thermal power which is greater than the rate of heat loss of the single aerosol-forming segment, while at the same time with the aid of the alternating magnetic field having the predetermined magnetic field strength and the predetermined frequency generating in each aerosol-forming segment other than the single aerosol-forming segment a thermal power which is smaller than the rate of heat loss of the respective other aerosol-forming segment.

13. The method according to claim 12, wherein the method comprises during a first period of time with the aid of the alternating magnetic field having a first predetermined magnetic field strength and a first predetermined frequency generating in the single aerosol-forming segment a thermal power which is greater than the rate of heat loss of the single aerosol-forming segment, and during a second period of time subsequent to the first period of time with the aid of the alternating magnetic field having a second predetermined magnetic field strength and a second predetermined frequency generating in a further single aerosol-forming segment a thermal power which is greater than the rate of heat loss of the further single aerosol-forming segment.

14. The method according to claim 8, wherein the method comprises with the alternating magnetic field having the predetermined field strength and the predetermined frequency generating in a first aerosol-forming segment of the plurality of aerosol-forming segments a thermal power which is greater than the rate of heat loss of the first aerosol-forming segment, and with the alternating magnetic field having the predetermined magnetic field strength and the predetermined frequency at the same time generate in at least one further aerosol-forming segment different from the first aerosol-forming segment a thermal power which is greater than the rate of heat loss of the at least one further aerosol-forming segment.

15. The aerosol delivery system according to claim 1, wherein the at least two different susceptors are thermally separated from each other by a thermo-insulating wall.

16. The aerosol delivery system according to claim 1, wherein the at least two different susceptors include a first susceptor and a second susceptor that are configured such that, at the predetermined frequency, only one of the first susceptor and the second susceptor is heated.

17. The aerosol delivery system according to claim 1, wherein the aerosol-forming article, including the at least two different susceptors, is removably insertable into the cavity of the inductive heating device.

* * * * *